US006324976B1

(12) United States Patent
Thoele et al.

(10) Patent No.: US 6,324,976 B1
(45) Date of Patent: Dec. 4, 2001

(54) DEVICE FOR THE POSITIONING AND REMOVAL OF AN INK CHAMBER DOCTOR AT THE ANILOX ROLLER OF A PRINTING MACHINE

(75) Inventors: Alois Thoele; Fritz Achelpohl, both of Lienen (DE)

(73) Assignee: Windmöller & Hölscher, Lengerich (DE)

( * ) Notice: Subject to any disclaimer, the term of this patent is extended or adjusted under 35 U.S.C. 154(b) by 0 days.

(21) Appl. No.: 09/422,239

(22) Filed: Oct. 21, 1999

(30) Foreign Application Priority Data

Oct. 22, 1998 (DE) ..... 198 48 773

(51) Int. Cl.[7] ..... B41F 31/00

(52) U.S. Cl. ..... 101/350.6; 101/352.07; 101/352.09; 101/352.05

(58) Field of Search ..... 101/348, 349.1, 101/350.6, 351.3, 351.4, 351.8, 352.04, 352.05, 352.09, 352.07, 366

(56) References Cited

U.S. PATENT DOCUMENTS 4,938,133 * 7/1990 Bock et al. ..... 101/350.6
4,964,336 * 10/1990 Bock et al. ..... 101/350.6
5,088,402 * 2/1992 Hycner et al. ..... 101/142
5,140,901 * 8/1992 John ..... 101/350.6

FOREIGN PATENT DOCUMENTS 38 32 160 4/1990 (DE) .
43 08 711 9/1994 (DE) .

* cited by examiner

*Primary Examiner*—Daniel J. Colilla
(74) *Attorney, Agent, or Firm*—Jacobson Holman, PLLC

(57) ABSTRACT

An ink chamber doctor, bearing two doctor blades that are arranged in the shape of a roof can be placed in position at an anilox roller of a printing machine and moved away from the same. To guarantee that the central plane of the ink chamber doctor always agrees with a diametral plane of the anilox roller so that the result is a uniform wearing of the doctor blades, the side faces of the strip-shaped housing of the ink chamber doctor bear guide means, which can be used in guides of the side members. The ink chamber doctor can be slid in the guides at least in its end region facing the anilox roller up to its positioning at said anilox roller in a plane that includes both the central plane of the ink chamber doctor and also the axis of the anilox roller. Furthermore, means for pressing the ink chamber doctor against the anilox roller and/or for holding the ink chamber doctor at the anilox roller are envisaged.

20 Claims, 7 Drawing Sheets

DEVICE FOR THE POSITIONING AND REMOVAL OF AN INK CHAMBER DOCTOR AT THE ANILOX ROLLER OF A PRINTING MACHINE

BACKGROUND OF THE INVENTION

1. Field of the Invention

The invention relates to a device for the positioning and removal of an ink chamber doctor, bearing two doctor blades, arranged in the shape of a roof, at the anilox roller of a printing machine, which is mounted in the side members of an anilox roller block, which can be slid in a guide in the direction of a press roller in a printing machine.

2. Description of the Related Art

It is known to press the ink chamber doctors, which comprise a strip-shaped housing with a central ink channel and doctor blades, which are fastened on the side of doctors and which are symmetrical to the central plane, and exhibit side seals, against the anilox roller using swivel levers and pressure medium-piston-cylinder units, which act on said levers. As a consequence of this swivelable mounting of the ink chamber doctor, the doctor blades are subject to non-uniform wear, so that, as the wear increases, the position of the doctor blades relative to the anilox roller changes because the ink chamber doctor tends to slope slightly relative to a diametral plane of the anilox roller. In the case of severe wear of the doctor blades the central plane of the ink chamber doctor can rotate so far out of the diametral plane of the anilox roller that a proper doctoring can no longer be guaranteed.

SUMMARY OF THE INVENTION

Therefore, the object of the invention is to provide a device of the type described in the introductory part that guarantees that the central plane of the ink chamber doctor will always agree with a diametral plane of the anilox roller, and in particular irrespective of the wear of the doctor blades.

The invention solves this problem with a device in which the side faces of the strip-shaped housing of the ink chamber doctor bear guide means, which are used in guides of the side members of the anilox roller block, and in which the ink chamber doctor is slid in the guides at least in its end region facing the anilox roller up to its placement in position at said anilox roller in a plane that includes both the central plane of the ink chamber doctor and also the axis of the anilox roller. An element for pressing the ink chamber doctor against the anilox roller and/or for holding the ink chamber doctor at the anilox roller may also be included.

Since the ink chamber doctor remains parallel to itself when placed in position and pressed against the anilox roller because the displacement plane of the ink chamber doctor that is its central plane aligns with a diametral plane of the anilox roller, the doctor blades, which are arranged symmetrically to the central plane of the ink chamber doctor, can wear only uniformly so that irrespective of the ink chamber doctor's degree of wear the same and correct angle position to the anilox roller is always maintained.

Expediently the guide means are arranged on supports, connected to the faces of the ink chamber doctor.

A preferred embodiment provides that the guide means comprise two bolts, which are spaced apart in the central plane, and the guides comprise grooves, recessed in the side members. These groove align with a diametral plane of the anilox roller.

Preferably the bolts penetrate a slider with two parallel side faces, which arc parallel to the plane, extending from the center lines of the bolts, and on which guide members or rolls, arranged on both sides of the last straight section of the grooves, run. This design also achieves a straight guide for the ink chamber doctor so that it is guaranteed that, irrespective of the wear of the doctor blades, the central plane of the ink chamber doctor aligns with a diametral plane of the anilox roller.

Expediently the straight end pieces of the grooves extend from a recess of the side members that is open at the top and into which the guide bolts of the ink chamber doctor can be inserted.

The bottom sides of the recesses can align with the bottom flanks of the grooves.

Another preferred embodiment provides that the bottom sides of the recesses arc provided on their ends opposite the grooves with approximately semicircular recesses, whose radius is equivalent to the radius of the bolts, that each bolt can be inserted into each recess and that at least one side member is provided with a hook-shaped latch, resting against an abutment face and with which the other bolt can be stopped after the ink chamber doctor has been swung around the bolts inserted into the recesses. In this manner the ink chamber doctor, retracted from the anilox roller, can be swung out so that the doctor blades and the ink channel arc readily accessible.

A support with inclined faces for guiding purposes can be arranged in the central region of the recess, serving the purpose of inserting the bolts of the ink chamber doctor. These inclined faces ensure that the ink chamber doctor, inserted with downward pointing doctor blades into the recess, can be correctly rotated by 90° in order to enter into the straight guide section of the grooves, which guarantee that the ink chamber doctor will be pressed symmetrically against the anilox roller.

Another embodiment of the invention provides that in the side members above the straight line guide grooves spring-loaded levers, which exhibit freely tapering slots and are connected by means of linkages or a pipe, are pivot-mounted synchronously in the side members. When entering the straight guide grooves, the ink chamber doctor's bolts, facing the doctor blades, enter into the lever's slots. These levers guarantee that the ink chamber doctor can be placed in position at the anilox roller so as not to tilt.

Expediently the levers are loaded by springs, whose tension increases as the bolts enter into the slots when the ink chamber doctor moves in the direction of the anilox roller, whereby the springs move the ink chamber doctor with a readily flexible spring action against the anilox roller, when the spring force lines have moved through the lever's swivel axis.

To press the ink chamber doctor with the necessary pressure against the anilox roller, the levers are provided with an abutment for the piston of a pressure medium cylinder.

BRIEF DESCRIPTION OF THE DRAWINGS

One embodiment of the invention is explained in detail in the follow with reference to the drawings.

DETAILED DESCRIPTION OF THE PREFERRED EMBODIMENTS

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

Figure 1:
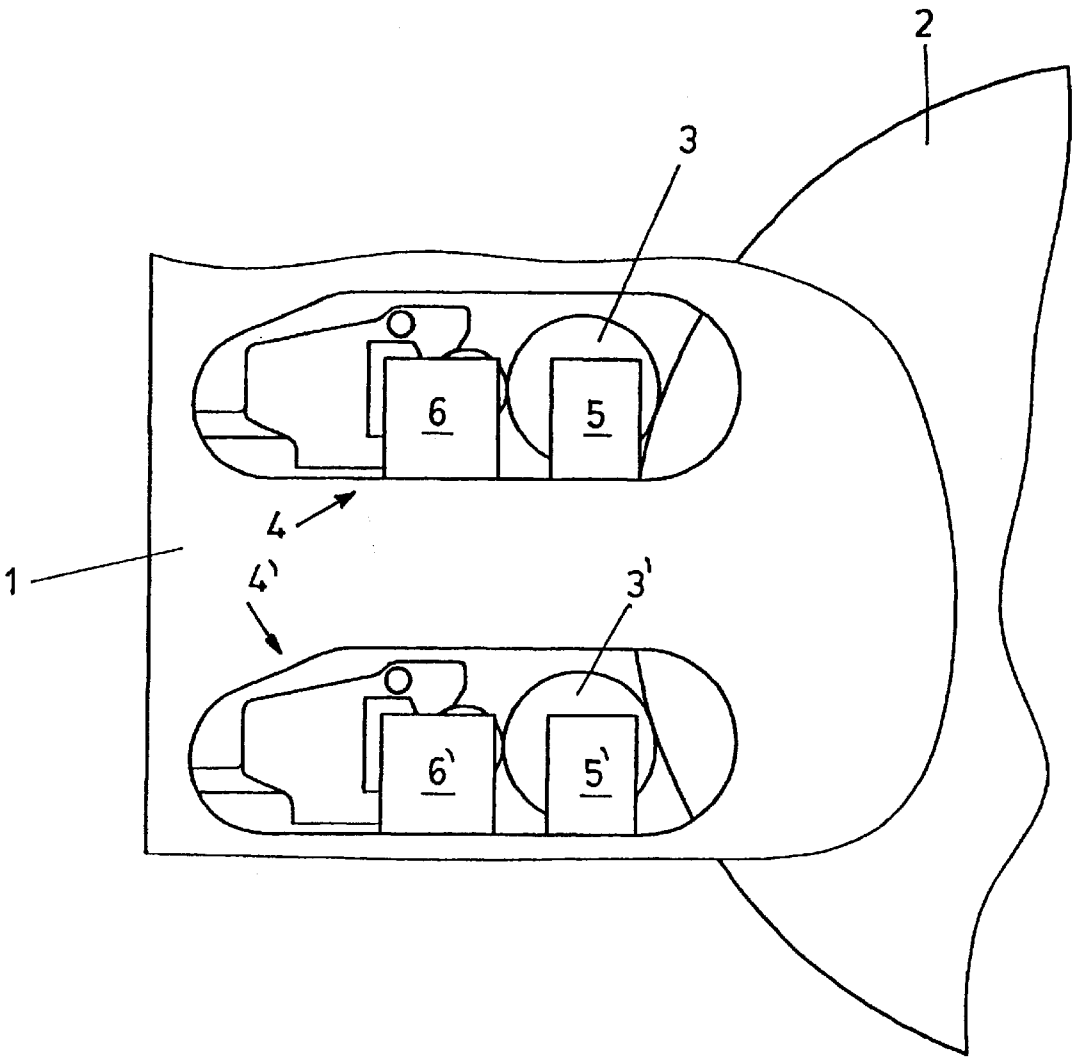
FIG. 1 is a diagrammatic side view of two ink units, positioned at a common counter pressure cylinder of a printing machine.

FIG. 1 depicts a side frame 1 of two side members of a printing machine (not illustrated in detail), in which there is mounted a counter pressure cylinder 2, at which the block-bearing impression cylinders 3, 3' of two printing units 4, 4' can be put into position. The printing units 4, 4' are visible through windows of the side member, whereby below the window cutouts there are guides for the press roller bearing blocks 5, 5' and the anilox roller bearing blocks 6, 6'.

Figure 2:
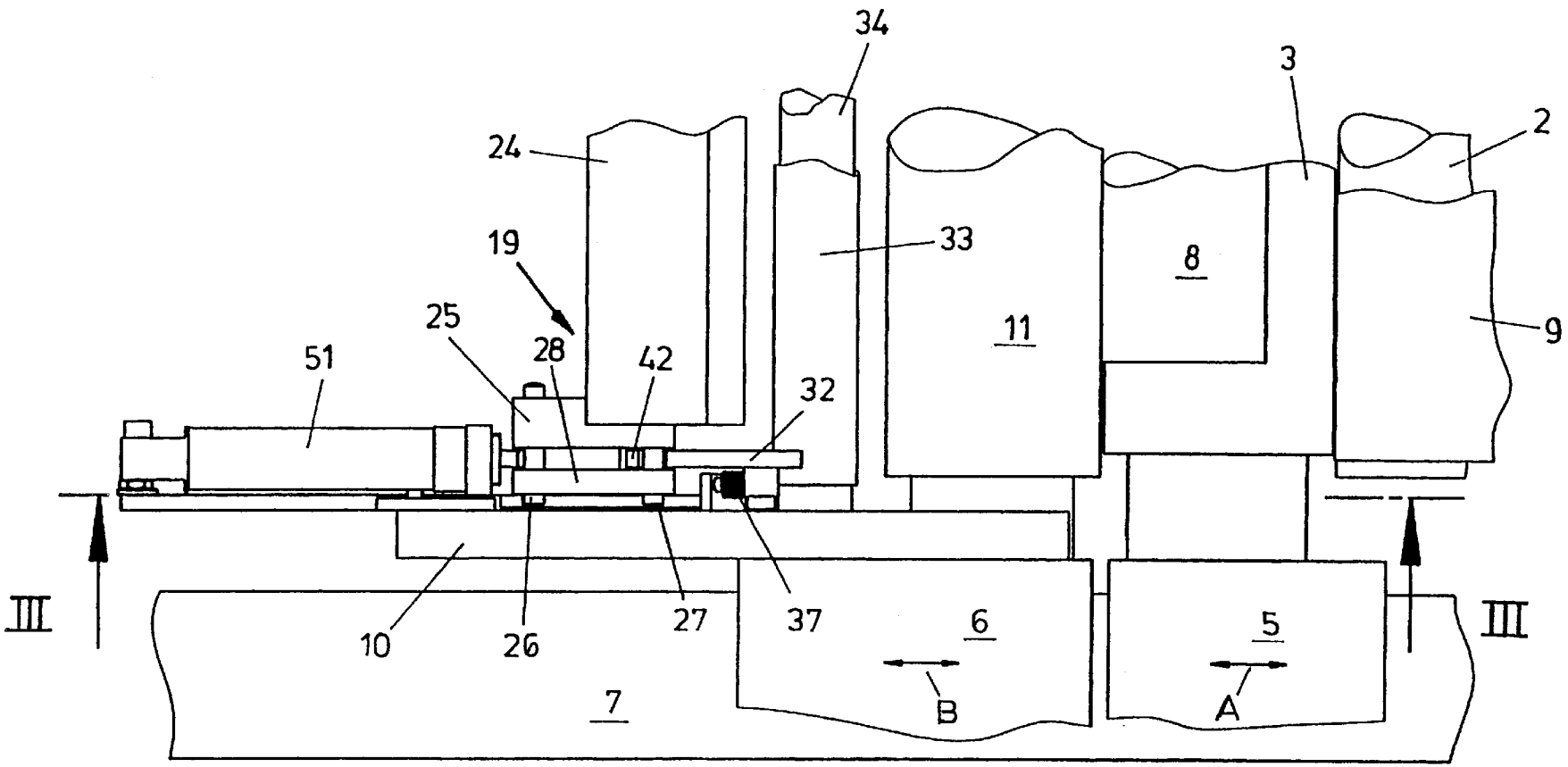
FIG. 2 is a top view of a side of a printing unit according to FIG. 1.

The bearing blocks 5, 6 can be moved in the usual manner on their guide rails 7, depicted in FIG. 2, in the direction of the double arrows A and B. The opposite side frame is provided with a corresponding guide rail, on which the bearing blocks of the press roller and the anilox roller can be moved synchronously.

As evident from FIG. 2, the press roller 3 bears blocks 8. A web 9 to be printed runs over the counter pressure roller 2.

Figure 6:
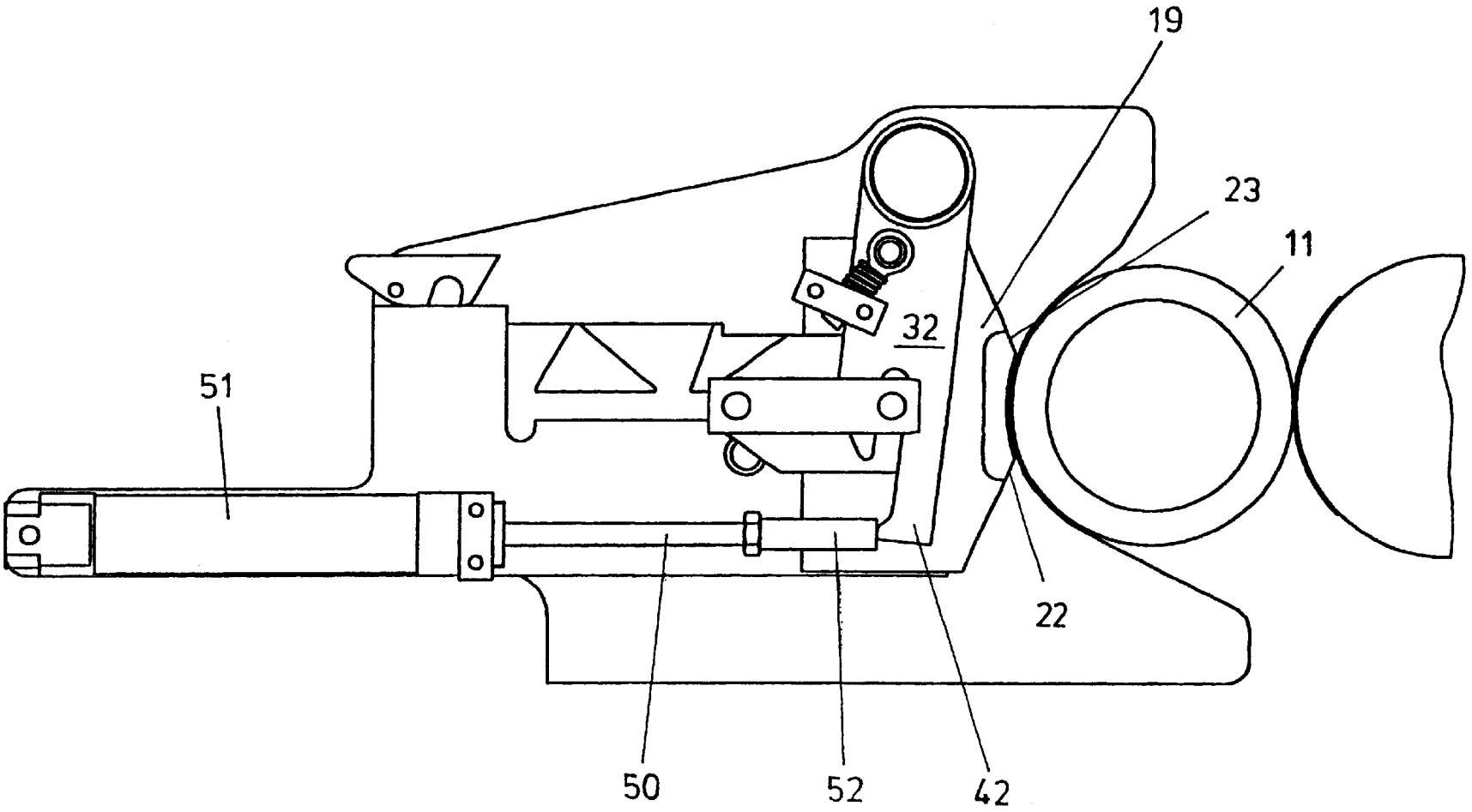
FIG. 6 is a view corresponding to that of FIGS. 3 to 5, where the ink chamber doctor is in its press-on position at the anilox roller.

In the side members of the anilox roller bearing block 6, of which FIG. 2 shows only one side member 10, the anilox roller 11 is mounted in the usual manner. When operating, an ink chamber doctor 19 is placed in position and pressed against the anilox roller 11, as shown in FIG. 6. The insides of the side frame 10 are provided with a recess 12, which is open at the top and whose bottom step-like side 13 aligns with the bottom flank of a groove 14, which runs in a diametral plane of the anilox roller 11. The floor of the groove 14 aligns with the side wall of the recess 12. In the recess 12 there is a triangular support 15, whose sides 16, 17 form guides. On its side opposite the groove 14 the bottom edge 13 of the recess 12 exhibits a somewhat semicircular depression 18.

The recess 12 serves to introduce an ink chamber doctor 19 to be inserted into the ink unit. The ink chamber doctor 19 comprises a strip-shaped housing 20, which extends longitudinally and whose one side is provided with an ink channel 21. On both sides of the ink channel 21 the strip 20 is provided, symmetrically to its longitudinal central plane that runs through the ink channel 21, with roof-shaped sloped surfaces, on which the doctor blades 22, 23, shown in FIG. 6, are fastened in the usual manner symmetrically to the longitudinal central plane. The external sides of the ink channel 21 are closed in the usual manner with seals. The lines, serving to supply the ink and drain it, are not shown for the sake of a better overview.

These supports 25, which project toward the bottom, are connected to the parallel faces 24 of the ink chamber doctor 19. The spaced apart bolts 26, 27 are fastened on said supports in the central plane of the ink chamber doctor. The bolts 26, 27 penetrate a right angle slider 28, whose sliding surfaces 29, 30 are parallel to the longitudinal central plane of the ink chamber doctor 19. Between the front sides of the supports 25 and sliders 28 there remains a slit, as depicted in FIG. 2. The bolts 26, 27 project beyond the sliders 28.

Two levers 32 are pivot-mounted in the side members 10 above the guide grooves 14. For the purpose of synchronous movement said levers are fastened to a pipe 33, which is pivot-mounted on a bar or a pipe 34. The pipe 34 forms a traverse, which is connected permanently to the side members 10. The levers 32 are provided with bars 36, which can be swivelled around axle journals 35, which are parallel to the levers 32 and which serve to mount a compression spring 37, which is braced, on the one hand, against the bearing eye and, on the other hand, against an abutment 38, which is fastened to the side member 10. The compression spring 37 and the journal 35 are arranged in such a manner that when the lever 32 is swung out of its position, shown in FIG. 3, into its position, shown in FIG. 6, the force line of the compression spring moves through the axis of the pipe 33 so that after moving through the dead point, formed by the axis, the spring loads the lever 32 with opposite direction of swing.

The free ends of the levers 32 are provided with freely tapering slots 40. The bottom legs 41 of the levers, divided by the slots 40, are designed longer and bear on their bottom end an inwardly facing projection 42.

On both sides of the groove 14 guide rolls 43 are arranged in parallel rows to the said groove.

Figure 3:
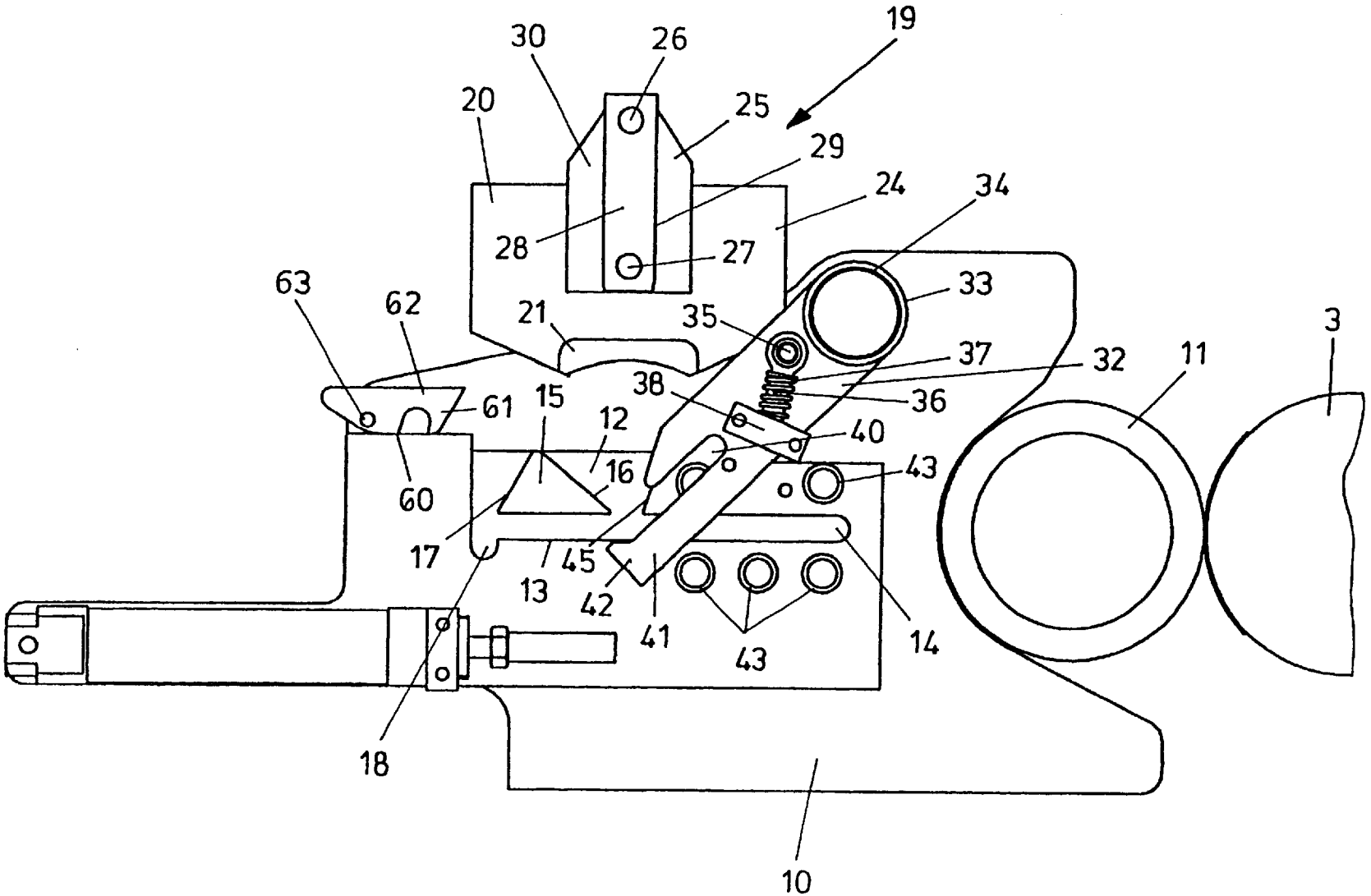
FIG. 3 is a sectional view of a printing unit along the III—III in FIG. 2 with an ink chamber doctor, which is to be inserted into the same.
Figure 4:
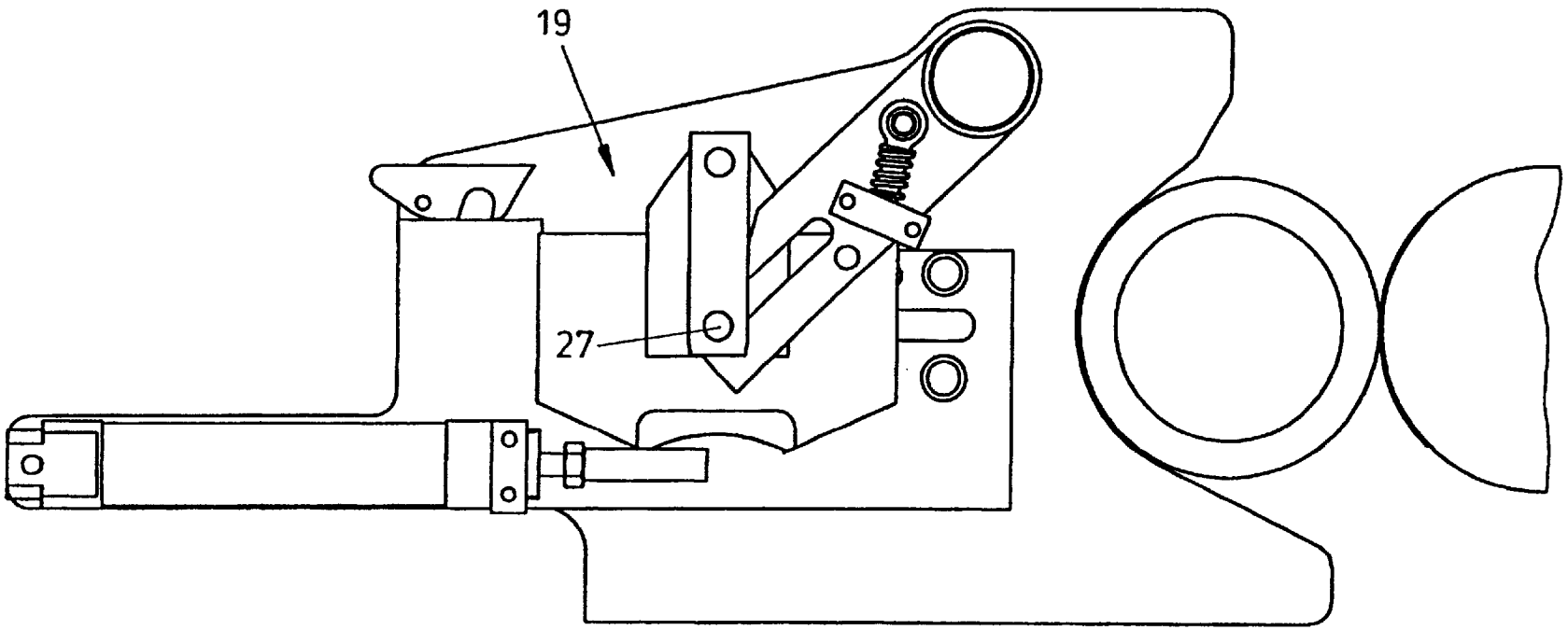
FIG. 4 is a view corresponding to that of FIG. 3 during insertion of the ink chamber doctor.
Figure 5:
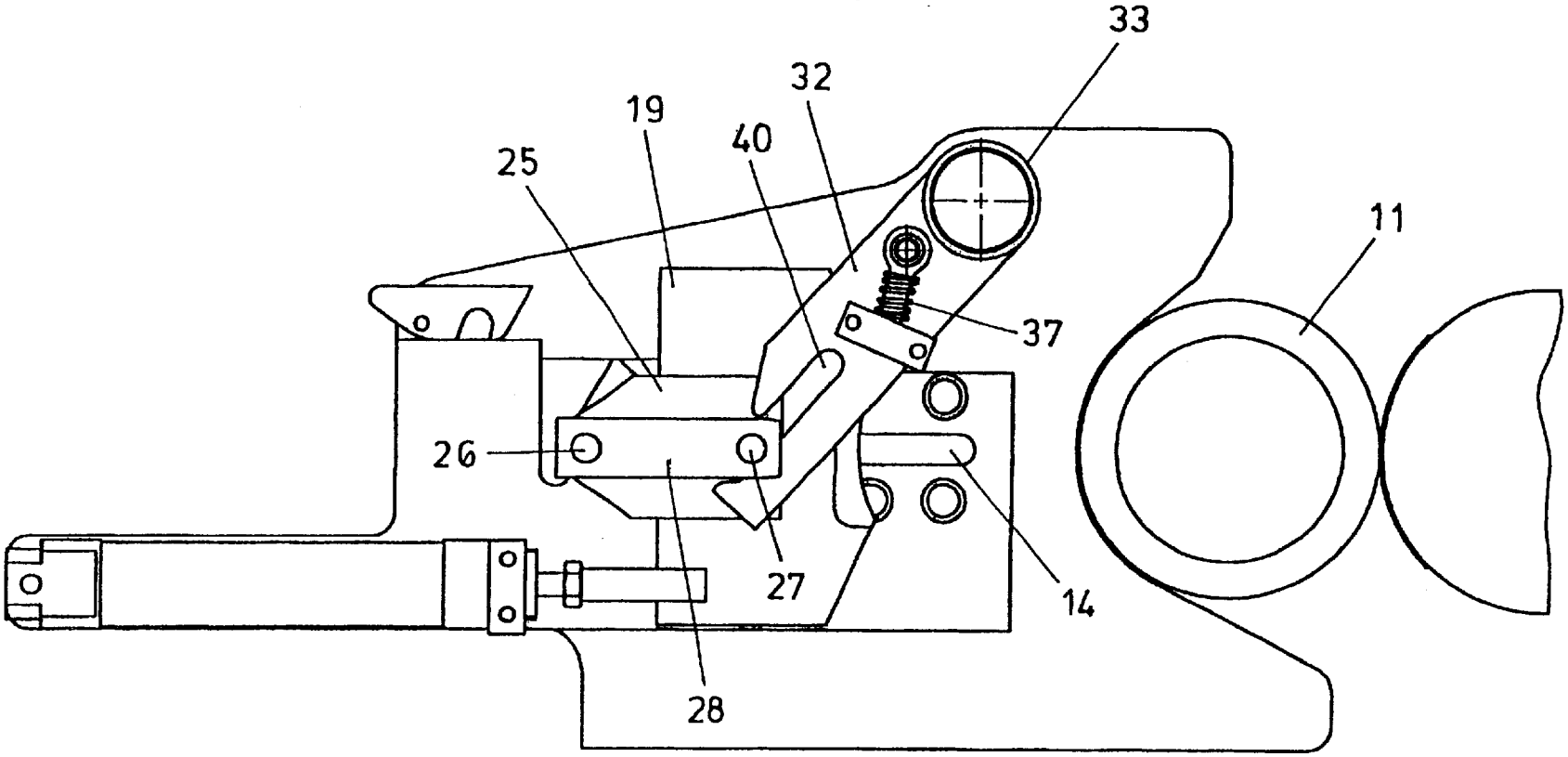
FIG. 5 is a view corresponding to that of FIGS. 3 and 4, where during its insertion the ink chamber doctor has reached the inlet into the guide grooves.

To immerse the ink chamber doctor, it is guided, as shown in FIG. 3, into the anilox roller bearing block with downwardly facing ink channel 21, and in particular in such a manner that the bottom pins of the bolts 27, protruding beyond the sliders 28, are inserted into the recess 12 over inclined faces 16 and the opposite inclined face 45 until the ends of the bolts 27 strike the bottom surface 13 of the recess 12. This position of the ink chamber doctor is evident from FIG. 4. In this position the bottom, freely protruding ends of the bolts 27 also rest against the projection 42 of the bottom leg 41 of the levers 32. The ink chamber doctor 19 is then swung 90° out of the position, shown in FIG. 4, into its position, shown in FIG. 5. In this position the projecting ends of the guide bolts 26, 27 align with the groove 14. At the same time the bolts 27 are in a segment lying between the slider 28 and the support 25 in an inlet region of the slot 40 of the lever 32. At this stage the ink chamber doctor 19 is moved, for example, manually into this position in the direction of the anilox roller 11. During this displacement process the tension of the compression spring 37 increases, until the force line of the compression spring moves through the central axis of the pipe 33 so that the levers 32 now endeavor to move the ink chamber doctor 19 so as to rest against the anilox roller 11, as depicted in FIG. 6. After the ink chamber doctor has been moved thus against the anilox roller, the piston rods 50 are moved out by pressure medium cylinders 51, which are hinged in the side members, in such a manner that they rest with their pressure members 52 against the projections 42 and press by way of the levers 32 the center of the ink chamber doctor 19 against the anilox roller 11.

Figure 7:
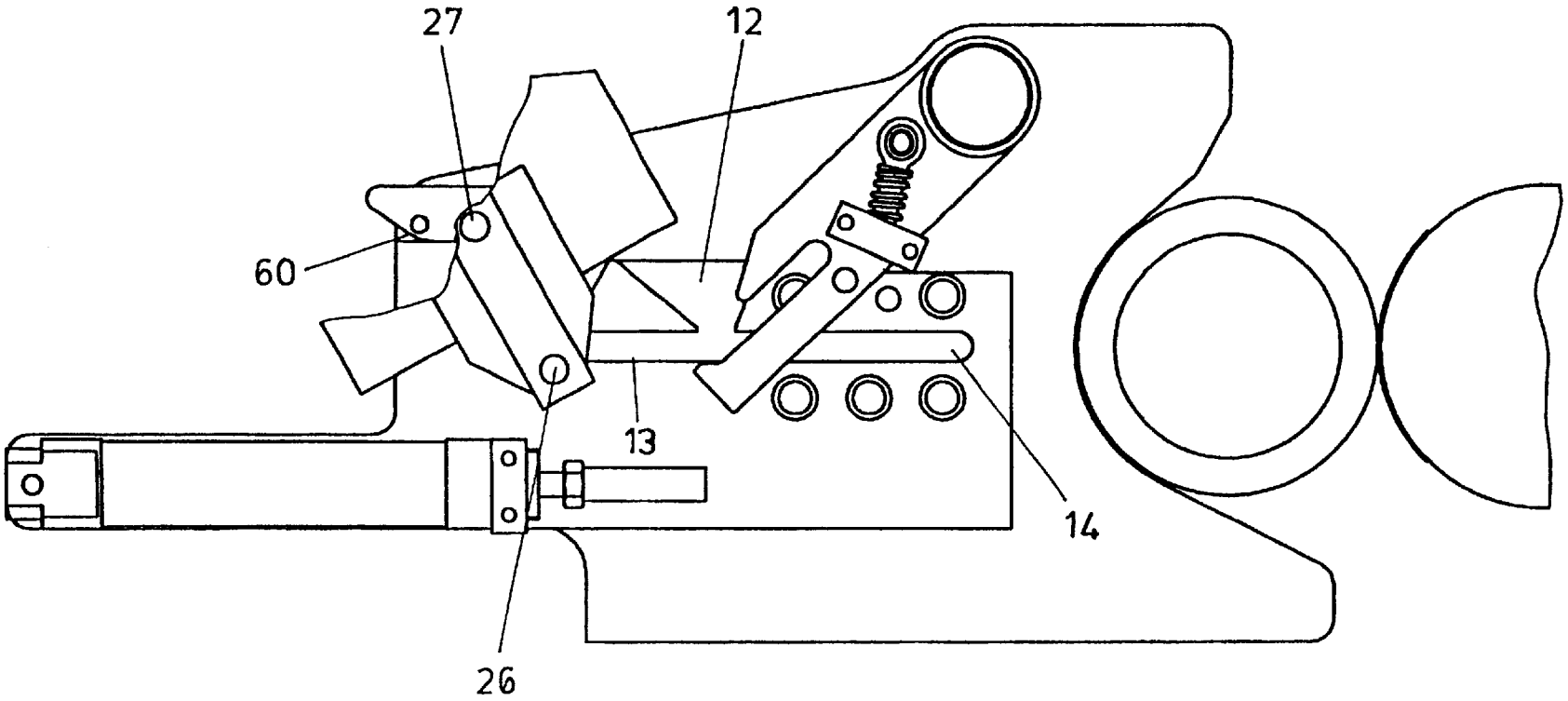
FIG. 7 is a view corresponding to FIG. 3, where the ink chamber doctor is retracted from the guide grooves and is stopped in a swivel position, in which the doctor blades and the ink channel are accessible.

If the doctor blades 22, 23 are to be interchanged or the ink chamber doctor is to be repaired in the conventional manner, the ink chamber doctor 19 is slid back into the guide groove 14 and on the bottom edge 13 of the recess 12 until the bolts 26 fall into the recesses 18. In this position the opposite bolts 27 leave the groove 14 so that the ink chamber doctor can be swung around the bolts 26 in the recesses 18 into the position, which is shown in FIG. 7 and where the bolts are braced against the abutment face 60 of the side members. Above the abutment face 60 a ratchet lever 62, provided with a hook 61, can be pivoted around an axle journal 63, which is fastened to the side members. This ratchet lever 62 engages in the position of the ink chamber doctor, depicted in FIG. 7, behind the cantilevered pins of the bolts 27 so that the ink chamber doctor is fixed in its readily accessible position, as shown in FIG. 7.

The invention being thus described, it will be apparent that the same may be varied in many ways. Such variations are not to be regarded as a departure from the spirit and scope of the invention, and all such modifications as would be recognized by one skilled in the art are intended to be included within the scope of the following claims.

What is claimed is:

1. A device for positioning and removing an ink chamber doctor at an anilox roller of a printing machine, said ink chamber doctor having a housing with side faces and bearing two doctor blades, and the device mounted in side members of an anilox roller block, said device comprising:

a first plurality of guide elements on said side faces;

a second plurality of guide elements on said side members, said second plurality of guide elements including a guide groove extending perpendicular to a nearest surface of said anilox roller and along a same plane as an axis of said anilox roller;

said first plurality of guide elements guided within said second plurality of guide elements to allow said ink chamber doctor to slide along the same plane in the guide groove to a position with said doctor blades at said anilox roller, said same plane including a central plane of said ink chamber doctor; and a pressure member for holding said ink chamber doctor at the anilox roller.

2. The device as set forth in claim 1, wherein said first plurality of guide elements are arranged on supports connected to said side faces of said ink chamber doctor.

3. The device as set forth in claim 1, wherein said first plurality of guide elements includes two guide bolts spaced apart in the central plane of said ink chamber doctor, and said second plurality of guide elements includes guide rolls arranged on either side of said guide groove.

4. The device as set forth in claim 3, wherein said two guide bolts penetrate a slider having two side faces which are each parallel to said central plane extending from a center line of said bolts, said side faces of said slider running along said guide rolls as said ink chamber doctor slides along said guide groove.

5. The device as set forth in claim 3, wherein said guide groove is entered through a recess in said side members which is open at a top and into which said guide bolts are inserted.

6. The device as set forth in claim 5, wherein a bottom surface of said recess aligns with a lower surface of said guide groove.

7. The device as set forth in claim 5, said recess having in a central region a support with two inclined faces for guiding the insertion of said guide bolts.

8. The device as set forth in claim 1, wherein said first plurality of guide elements includes first and second guide bolts spaced apart in the central plane of said ink chamber doctor, said first guide bolt closest to said doctor blades.

9. The device as set forth in claim 8, wherein said guide groove is entered through a recess in said side members which is open at a top and into which said first and second guide bolts are inserted, a bottom surface of said recess aligning with a lower surface of said guide groove.

10. The device as set forth in claim 9, wherein an end of said bottom surface opposite said guide groove includes a semicircular recess having a radius substantially equivalent to a radius of said second guide bolt and at least one side member includes a hook-shaped latch such that, when said ink chamber doctor is slid away from said anilox roller until said second guide bolt is inserted into said recess, said ink chamber doctor is rotatable around said second guide bolt until said first guide bolt is stopped by said latch.

11. The device as set forth in claim 8, further comprising a lever pivotally mounted to each side member above said guide groove, said lever having a free end with a slot therein, said first guide bolt engaging said slot when said ink chamber doctor is inserted into said guide groove.

12. The device as set forth in claim 11, wherein said lever is loaded by a spring, a tension on said spring increasing as said first guide bolt enters said guide groove and moves toward said anilox roller and then, when spring force lines of said spring have moved through a swivel axis of said lever, said spring biasing said ink chamber doctor against said anilox roller with a spring action.

13. The device as set forth in claim 11, wherein said free end of said lever includes an abutment for engaging the pressure member.

14. The device as set forth in claim 1, wherein said doctor blades undergo even wear due to positioning of said ink chamber doctor along the same plane as said axis of said anilox roller.

15. A device for positioning and removing an ink chamber doctor at an anilox roller of a printing machine, said ink chamber doctor having a housing and bearing two doctor blades, the device mounted in side members of an anilox roller block, said device comprising:

a first guide element on said housing;

a guide groove on at least one of said side members, said guide groove extending perpendicular to a nearest surface of said anilox roller and along a same plane as an axis of said anilox roller;

a lever pivotally mounted to said at least one side member above said guide groove, said lever having a free end with a slot therein, said first guide element engaging said slot when said ink chamber doctor is inserted into said guide groove, said first guide element being guided along said guide groove to allow said ink chamber doctor to slide along said same plane in the guide groove to a position with said doctor blades at said anilox roller, said same plane including both a central plane of said ink chamber doctor and the plane of said anilox roller axis; and a pressure member for engaging the free end of said lever to hold the ink chamber doctor at the anilox roller.

16. The device as set forth in claim 15, wherein said lever is loaded by a spring, a tension on said spring increasing as said first guide elements enters said guide groove and moves toward said anilox roller and then, when spring force lines of said spring have moved through a swivel axis of said lever, said spring biasing said ink chamber doctor against said anilox roller with a spring action.

17. The device as set forth in claim 15, wherein said housing includes a second guide element and a slider penetrated by said first and second guide elements, and said at least one side member includes a plurality of guide rolls arranged on both sides of said guide groove, said slider running along said plurality of guide rolls as said ink chamber doctor is moved within said guide groove.

18. The device as set forth in claim 17, wherein said guide groove is entered through a recess in said side member which is open at a top and into which said first and second guide elements are inserted, a bottom surface of said recess aligning with a lower surface of said guide groove.

19. The device as set forth in claim 18, wherein an end of said bottom surface opposite said guide groove includes a semicircular recess having a radius substantially equivalent to a radius of said second guide element and said side member includes a hook-shaped latch such that, when said ink chamber doctor is slid away from said anilox roller until said second guide element is inserted into said recess, said ink chamber doctor is rotatable around said second guide element until said first guide element is stopped by said latch.

20. The device as set forth in claim 15, wherein said doctor blades undergo even wear due to positioning of said ink chamber doctor along the same plane as said axis of said anilox roller.

* * * * *